US005899788A

United States Patent [19]

Hongisto

[11] Patent Number: 5,899,788

[45] Date of Patent: May 4, 1999

[54] METHOD AND APPARATUS FOR MANUFACTURING OF A LUMINOUS INDICATOR BOARD WITH OPTICAL FIBER

[76] Inventor: Aatto Hongisto, Visatie 6, FIN-39130 SASI, Finland

[21] Appl. No.: 08/646,378

[22] PCT Filed: Sep. 19, 1994

[86] PCT No.: PCT/FI94/00411

§ 371 Date: May 15, 1996

§ 102(e) Date: May 15, 1996

[87] PCT Pub. No.: WO96/09616

PCT Pub. Date: Mar. 28, 1996

[51] Int. Cl.[6] ..... G09F 13/00

[52] U.S. Cl. ..... 445/24; 445/66

[58] Field of Search ..... 362/32; 445/24, 445/66

[56] References Cited

U.S. PATENT DOCUMENTS

| | | | |
|---|---|---|---|
| 3,866,290 | 2/1975 | Norcross | 29/821 |
| 4,745,525 | 5/1988 | Sheehy | 362/32 |
| 5,040,320 | 8/1991 | Reidinger | 362/32 X |
| 5,066,085 | 11/1991 | Gimbutas et al. | 362/32 X |
| 5,101,466 | 3/1992 | Reidinger | 385/147 |

*Primary Examiner*—Kenneth J. Ramsey
*Attorney, Agent, or Firm*—Larson & Taylor

[57] ABSTRACT

A method of making a display board illuminated by optical fibers, in which method a display board illustrating different figures are produced by arranging the illuminating ends of the optical fibers into wanted spots onto the surface of the display board. Board perforation and feeding the optical fibers into holes as well as cutting off the optical fibers are carried out in successive steps using the same coordinate controlled punching and feeding device.

9 Claims, 2 Drawing Sheets

METHOD AND APPARATUS FOR MANUFACTURING OF A LUMINOUS INDICATOR BOARD WITH OPTICAL FIBER

The invention relates to a method and apparatus for making a display board illuminated with fiber optic elements.

Previously known are display boards accomplished with optical fibers, where the optical fibers have been, by hand, threaded into holes drilled in advance, fastened into the holes and cut to size so that they reach from the light source, often placed behind the board, to the board. Production of such boards is often time-consuming and expensive, because the number of optical fibers to be handled amounts to hundreds. Further, the worker is exposed to glue vapor in fixing the fibers to the board.

The method and apparatus according to this invention solve the actual problem in a surprising way and the invention is characterized in what is presented in the enclosed patent claims.

The major advantages of this invention can be considered the level of automation, which is reached by using a locally steered transfer gear, as for instance a coordination table, the transfer motions of which can be programmed. Thus it is possible to drill with the apparatus holes for any desired illuminated figure in the board and repeat the movements in order to install the optical fibers into respective holes. By means of an adhesive film to be fixed on the board underside, each optical fiber can be secured by simple means into its matching hole. As fiber feeding apparatus the wire feeding device of a wire welding machine applicable to the procedure can be applied without change. For fiber cutting a simple short-motion electrically actuated cutting device can be used.

Figure 1:
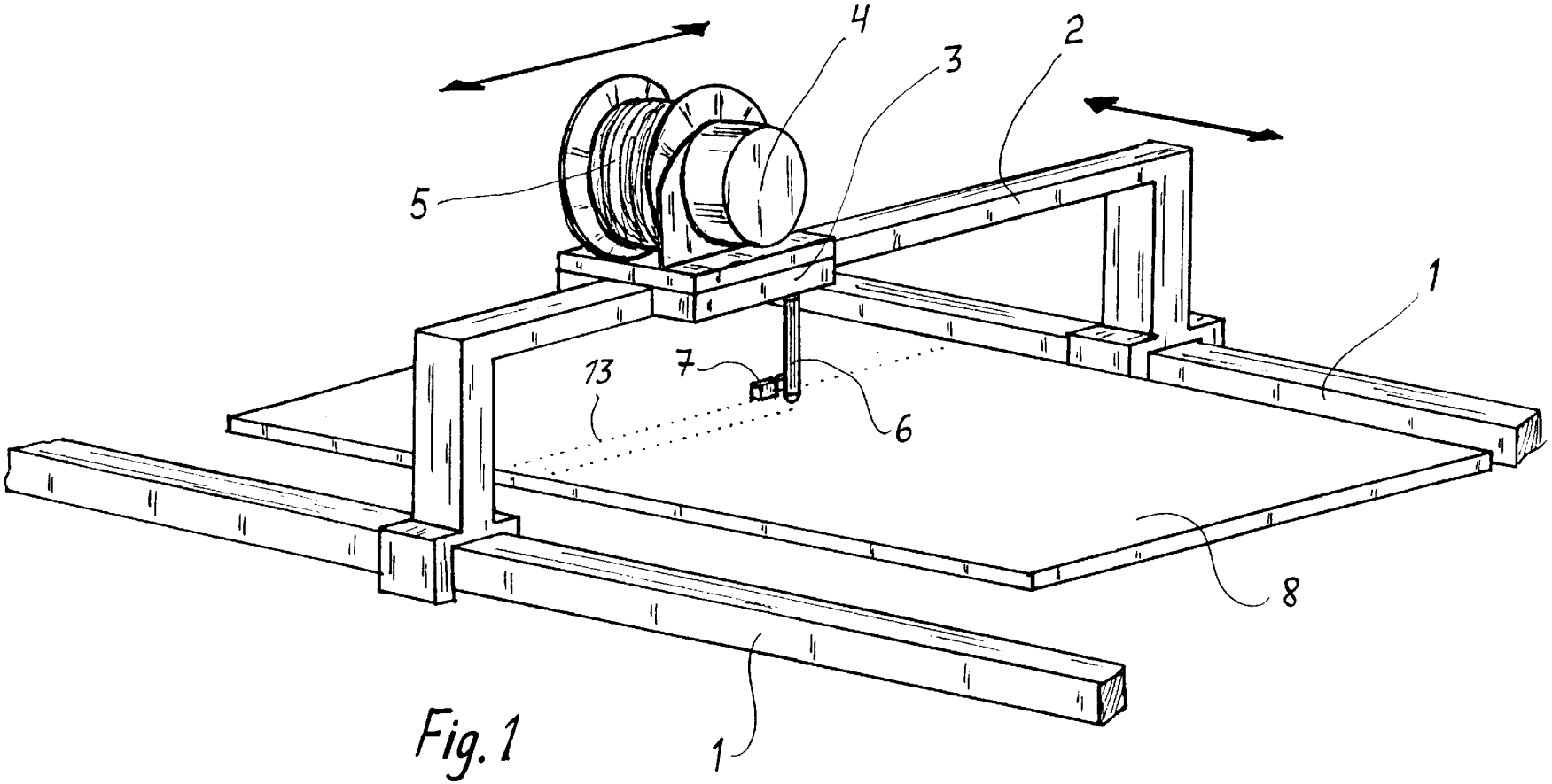
Figure 2:
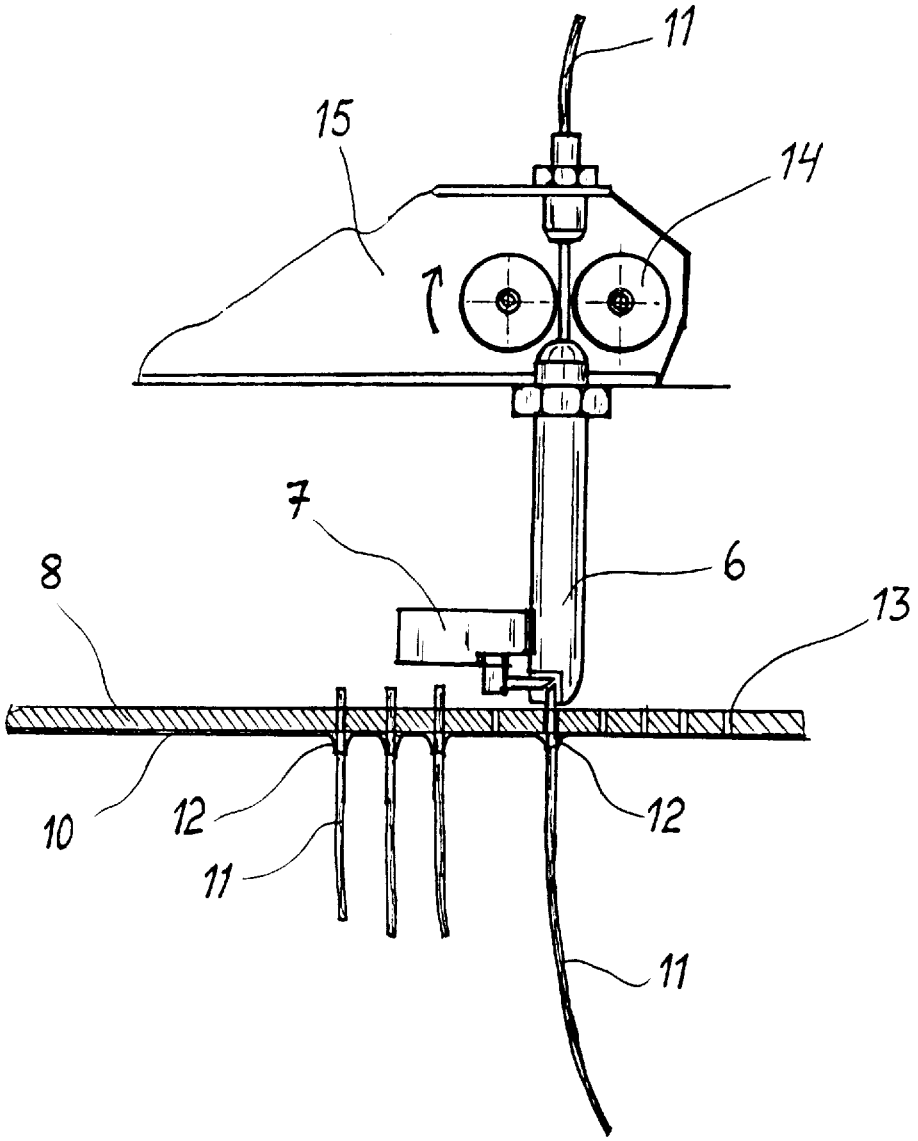
Figure 3:
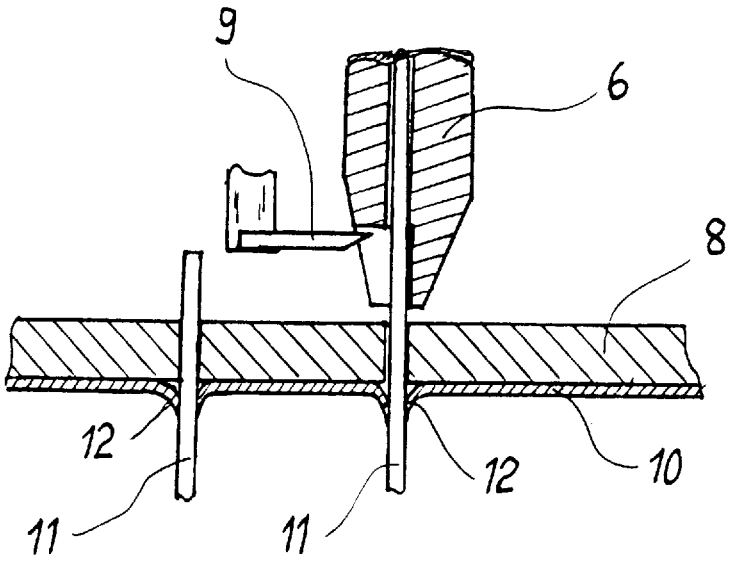

In the following the invention is disclosed with reference to the enclosed drawing, where FIG. 1 is a diagrammatic perspective view of a device for positioning of optical fibers on a display board;

FIG. 2 is a diagrammatic, partially sectional and enlarged side elevation view of a portion of the device of FIG. 1; and FIG. 3 is a diagrammatic, partially sectional, enlarged side elevation view of a portion of the device of FIG. 1.

FIG. 1 shows a coordination table formed by means of longitudinal guides 1 and transverse guides 2, on which table attaching part 3 can be moved above display board 8. Previously, the coordination table is known in itself and it includes programming devices, by means of which movements and stops to be done with the apparatus on the X-Y level can be determined in advance. Accordingly, the motions of attachment part 3 can be programmed in advance on board 8 surface, in order to drill holes 13, for instance. Holes 13 are drilled so that the wanted illustrated figure is produced when optical fiber ends are put into the holes. In the second stage the same holes are travelled over again while feeding optical fibers into them. Accuracy of the repeated procedure is retained if the board is not released from its brackets during and between different steps. In the drawing, there is on attachment part 3 an optical fiber feeding and cutting device with an optical fiber reel 5 and under protecting cap 4 any motors required for reel 5 rotation. On the underside of attachment part 3 there is a feeding tip 6, a cutting blade and a blade moving device 7.

FIG. 2 illustrates the feeding procedure and cutting. A wire feeding device of a wire welding machine equipped with feeding roles 14 is used to feed optical fiber 11. Optical fiber 11 comes from reel 5, travels through feeding tip 6 and goes through the board 8 hole 13 and is fed until a desired length of it extends from the underside of display board 8. When a drill has been fastened to the apparatus in place of feeding tip 6 in order to make the holes, and when the same X-Y level transfers are done for the second time, the optical fiber threaded through the feeding tip hits hole 13, exactly. When the hole is drilled through an adhesive film 10 on the underside of the board, the fiber bursts through the film, forming a collar section on the fiber and the glue inside the collar adheres to the fiber, becomes cured, and secures the optical fiber in the hole. Electrically actuated cutting device 7 cuts off the fiber before the apparatus shifts over the next hole. The length of the fiber can also be programmed in the automation system of feeding and transfer.

FIG. 3 illustrates cutting tip 6 on a bigger scale and shows a groove for motion of blade 9. The cutting blade can, of course, be placed much closer to the board surface. In tip 6 there is a groove at least allowing blade 9 to enter tip 6 so that cutting may work and the tip portion would be able to guide the fiber as close as possible to hole 13. If it also easy to add a device into the tip, which after cutting would push the optical fiber still closer to the board surface, for instance.

In one embodiment the attachment part 3 can be both a feeding tip 6 and a hole drilling device at the same side by side. Thereby, one of them or both can be in a separate transfer gear and can then be shifted to the desired position in attachment part 3 so that each works in the desired X-Y level position.

Another embodiment is that feeding tip 6 and the hole drilling device each respectively have a fixed position in attachment part 3, and the X-Y transfer automation knows the difference between the coordinates of their fixed positions and takes those positions into account when the apparatus is moved to the drilling position and to the optical fiber feeding position. On using adhesive film it is advantageous to make the holes first, then apply the adhesive film on the board underside, and finally feed the fiber into the holes.

When the illuminated figure is formed of a number of fibers of different colors or fibers divided into groups of one color illuminating at different times, it is advantageous to cut the fibers into bundles of one group each, each bundle having its own light source. Then only the cables supplying power to a certain group are connected to the light source of that group from the control unit.

The optical fiber can also be fixed to the board by spray gluing or dimensioning the hole narrow for the fiber by crimp connection or, for instance, by melting fiber into the hole with a hot cutting blade while cutting off the fiber.

What is claimed is:

1. A method of making a display board illuminated by optical fibers comprising the following steps:

(a) providing a plurality of holes in a board by means of a coordinate-controlled perforating machine;

(b) providing means mounted on said coordinate-controlled perforating machine for feeding an optical fiber into a selected hole in said board;

(c) positioning said coordinate-controlled perforating machine adjacent a front surface of said board to feed an optical fiber into a selected perforated hole in said board;

(d) actuating said fiber optic element feeding means to sequentially feed a desired length of said optical fiber into a plurality of said selected holes;

(e) sequentially cutting each optical fiber fed into each selected holes close to the front surface of the board to provide a desired length of optical fiber in each of said selected holes.

2. A method according to claim 1 further comprising combing a plurality of optical fibers into a bundle on one side of said board.

3. A method according to claim 1 wherein said board comprises an adhesive coating on a surface thereof for adhering said optical fibers to said board.

4. A method according to claim 1 further comprising fixing the optical fibers to said board by crimping.

5. A method according to claim 1 further comprising fixing the optical fibers to said board by spray gluing.

6. A method according to claim 1 further comprising fixing the optical fibers to the board by heating.

7. Apparatus for making a display board illuminated by optical fibers comprising:

(a) a coordinate-controlled perforating machine for providing a plurality of holes in a board;

(b) means mounted on said coordinate-controlled perforating machine for feeding an optical fiber into a selected hole in said board;

(c) means for positioning said coordinate-controlled perforating machine adjacent a front surface of said board to feed an optical fiber into a selected perforated hole in said board;

(d) means for actuating said optical fiber feeding means to sequentially feed a desired length of said optical fiber into a plurality of said selected holes; and (e) means for sequentially cutting each optical fiber fed into each selected hole close to the front surface of the board to provide a desired length of optical fiber in each of said selected holes.

8. Apparatus according to claim 7 wherein said coordinate-controlled perforating machine comprises a transfer gear.

9. Apparatus according to claim 7 wherein said coordinate-controlled perforating machine comprises a drill removably mounted thereon for providing said holes in said board, and means for removably mounting said optical fiber feeding means and said optical fiber cutting means in place of said drill.

* * * * *